US005611666A

United States Patent [19]

Au et al.

[11] Patent Number: 5,611,666

[45] Date of Patent: Mar. 18, 1997

[54] FLUID FORCING DEVICE

[76] Inventors: Ching Y. Au, P.O. 31205, Greenwich, Conn. 06831-0905; Lawrence Au, 1321 N. Rolfe St., Arlington, Va. 22209-3007

[21] Appl. No.: 626,566

[22] Filed: Apr. 2, 1996

[51] Int. Cl.[6] ..... B63H 1/37

[52] U.S. Cl. ..... 416/82; 417/436; 440/16

[58] Field of Search ..... 416/79, 80, 81, 416/82, 83; 415/125; 417/436; 440/16

[56] References Cited

U.S. PATENT DOCUMENTS 144,538 11/1873 Harsen ..... 416/82

3,620,651 11/1971 Hufton ..... 416/81

FOREIGN PATENT DOCUMENTS 836006 4/1952 Germany ..... 417/436

564018 9/1944 United Kingdom ..... 440/16

*Primary Examiner*—James Larson

[57] ABSTRACT

A fluid forcing device comprising many rotatable slender elements that converts mechanical energy into fluid energy by mechanically arranging and maintaining, at all times, the rotatable slender elements in a pre-determined wave form and by mechanically moving the wave form in a direction normal to the rotation of the elements.

4 Claims, 11 Drawing Sheets

FIG. 3 (VIEW A-A)

SECTIONAL VIEW JUST IN FRONT OF ROTATABLE ELEMENT 1

(VIEW C-C)

(VIEW D-D)

(SECTIONAL VIEW JUST IN FRONT OF ROTATABLE ELEMENT 1.)

(VIEW B-B)

FLUID FORCING DEVICE

BACKGROUND OF THE INVENTION

Studies of locomotions of aquatic animals have intensified recently because it is realized that evolution usually endowed long-existing creatures with efficient locomotion. However, few commercial products emulate such locomotions. One particularly efficient aquatic animal locomotion is the traveling wave method. Lampreys and water snakes use their whole body and cuttlefishes use their fin-like membranes to form a traveling wave. Liquid trapped in the moving recesses of the wave is carried rearward to obtain thrust.

Examples of the deficiencies of existing commercial products occur in oars and paddle wheels. The return stroke of oars wastes energy since no forward thrust is created by return strokes. In paddle wheels the liquid is not moved in the direction of thrust for part of the propelling cycle, especially in the rear of the paddle wheel.

In all such devices, mover-fluid coupling efficiency is important to make full use of available mechanical power. At the extreme ends of the speed range, the coupling efficiency is lower for paddles, oars, and propellers.

The following describes a mechanically produced traveling wave device emulating natural processes that can be used in marine propulsion and pumping fluid, providing a high efficiency of mover-fluid coupling.

SUMMARY OF THE INVENTION

The mechanically produced traveling wave fluid forcing device consists of a multiplicity of elements rotating around a central axle supported by a protective tray that also supports the driving components. Each element has a long vertical part that is immersed in fluid. The whole set of immersed vertical parts form the shape of the wave.

Each of the above elements has two shorter arms in the plane of rotation terminating with a roller. These arms and rollers are located in the protective tray which is above the fluid.

Each of the above elements also has a pin protruding from the front that goes in a slot in the rear of the previous element so that the relative rotation between elements is limited to a maximum angle. Any rotation beyond the maximum angle causes one element to drag the other element along.

Each element has its location fixed along the central axle, with a small clearance maintained with its neighbor. This clearance is small enough so that little fluid will leak through dynamically between elements. The first element is mechanically linked with the last element, so that the first element rotates together with the last element.

The complete set of elements will be arranged so that the immersed vertical parts will be arranged in the form of a single cycle of a desired wave. A symmetrical pair of mechanical driving systems, with one suitably out of phase with the other, will drive the two set of arms through their rollers.

When the driving systems are actuated, the wave will travel in the direction parallel to the central axle. The force produced by the device is the result of moving the fluid entrained in the curved recesses of the traveling wave. A drive pulley in the driving systems allows mechanical force to be coupled to the device, unless direct coupling is used.

The immersed portion of the elements could be enclosed in a duct to improve the coupling of the wave movement to the fluid movement. Seals to prevent back-flow may be added between the duct and elements and between adjacent elements.

The above fluid forcing device is primarily directed toward marine propulsion and pumping of fluids.

OBJECTS OF THE INVENTION

An object of the present invention is to provide the ability to move a fluid by means of interaction between the fluid and a set of immersed elements organized in the form of a traveling wave.

Another object of the present invention is to provide the ability to move a fluid against a back pressure using the same traveling wave means but with the addition of ducting and seals.

Another object of the present invention is to provide an even more efficient propulsion system by using the same traveling wave means but with the addition of ducting and seals.

DETAILED DESCRIPTION

Figure 1:
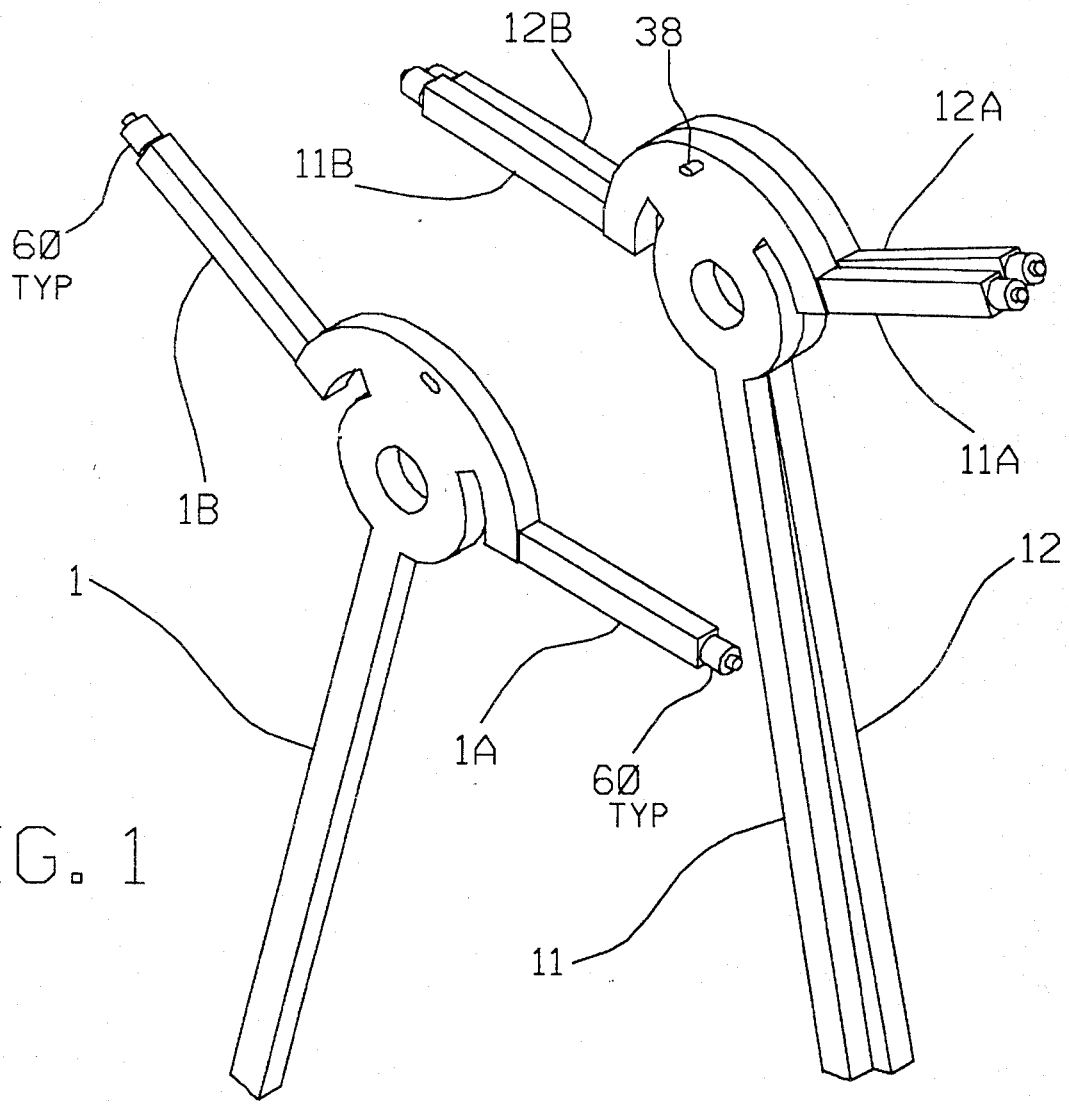
FIG. 1 is an isometric view of three of the rotatable elements.

Referring to FIG. 1, the first of the multiplicity of rotatable elements is shown as 1. It has a long vertical part and two shorter horizontal arms, each terminating with a roller 60. Just above the vertical part is a hole; the center of the hole is the center of rotation of the element. Above the hole is a curved slot which will accept a protruding pin from the next element. Element 11 is shown with the protruding pin 38. Element 12 is shown behind 11 and is shown rotated counter-clockwise relative to 11. The pin of 12 has reached the end of the slot in 11 so that, with any more rotation of 12, 11 will be dragged along. All rotatable elements are identical in fabrication, except for the first and last elements which have the additional feature of being attached to each other.

Figure 2:
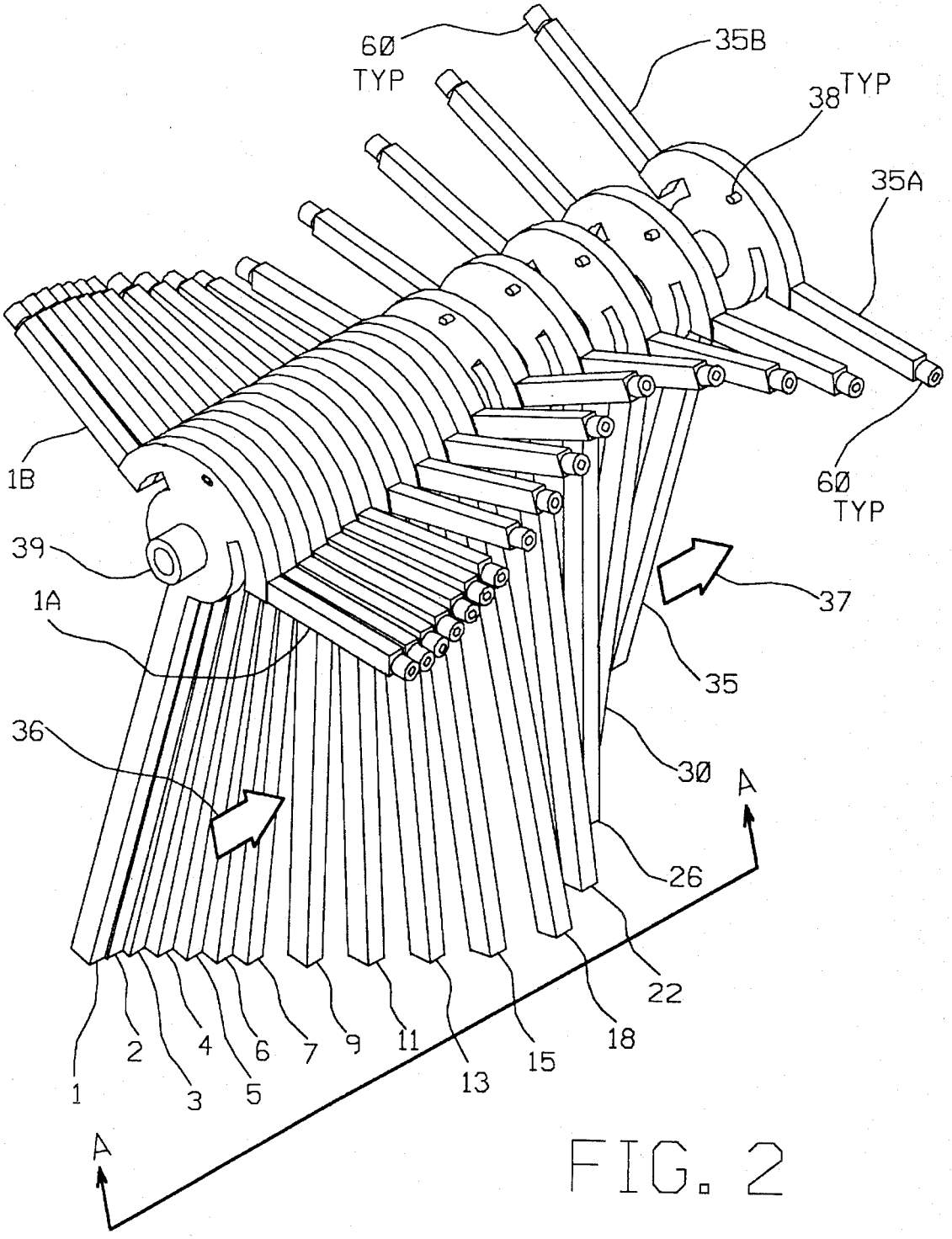
FIG. 2 is an isometric view of a majority of the rotatable elements, riding on the central axle.

FIG. 2 shows the majority of the rotatable elements, riding on the central axle. Some elements are omitted for clarity. Each element has a solid composite type of anti-friction bearing (not shown) for the amelioration of friction against the axle and against adjacent elements. The bearing also serves to maintain a small clearance between elements, a clearance just big enough to prevent rubbing between elements but small enough to act as a dynamic seal between elements.

The elements are arranged in such a way that the ends of the vertical parts, as well as the ends of the two sets of arms, form a pre-determined wave. The ends of 1 to 4, 15 to 21, and 32 to 35 form an arc of a circle; the ends of 4 to 15 and 21 to 32 form a straight line because of the limiting action of the pin-slot system described in FIG. 1.

All the vertical parts of the elements are immersed in a fluid. When the vertical parts are forced to rotate in such a way that the wave form is maintained but the wave as a whole is moving in the direction of the arrows 36 and 37, fluid in the region of 36 and 37 will be carried in the direction of the arrows.

Figure 3:
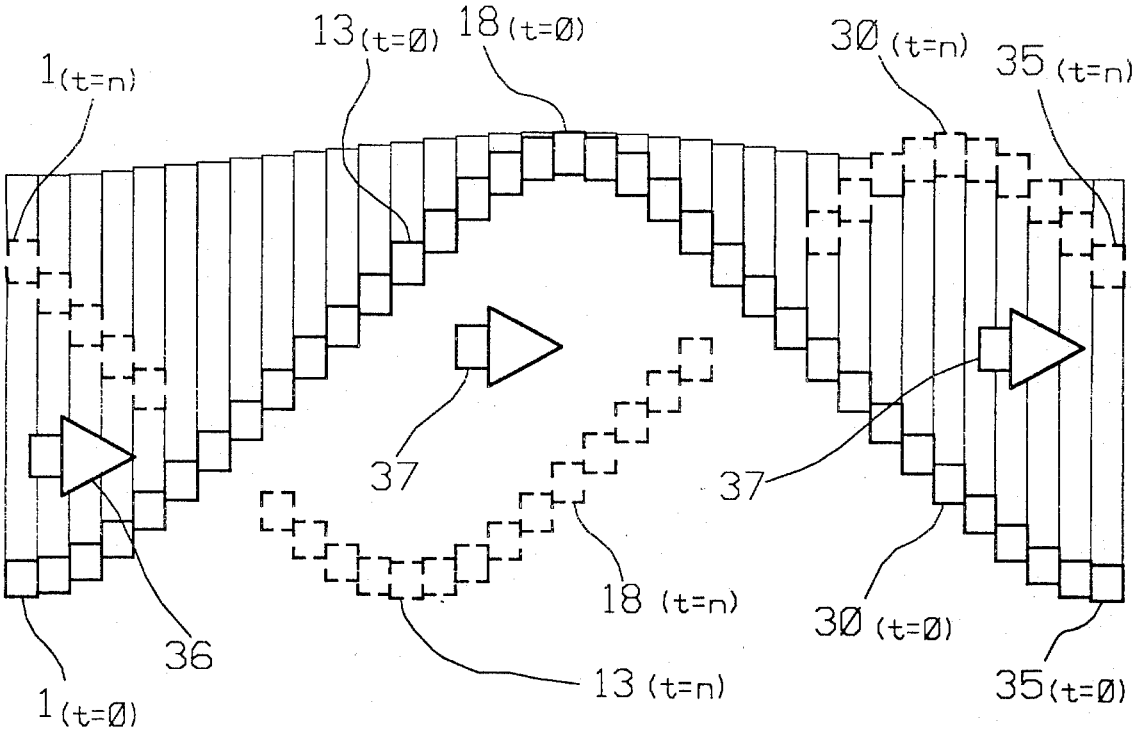
FIG. 3 is View A—A of FIG. 2, showing the ends of the vertical parts of the rotatable elements, arranged in the shape of a wave.

FIG. 3 shows the wave formed by the ends of the vertical part of the rotatable elements. Initially, at time equals zero, the ends are shown in solid lines and identified by the subscript t=0; n seconds later, the ends are shown in dotted lines and identified with the subscript t=n. This movement of the wave shows how the fluid in regions of the arrows 36 and 37 is carried by the wave.

It should be explained here that the rectangular shape of the immersed parts of the rotatable elements can have a shape that is more streamlined; rectangular shapes were drawn to achieve simplicity in graphics. In practice, the top and bottom of the rectangles could have curvature to reduce fluid resistance while the elements are rotated. The rotatable elements could also be made lighter by standard means to reduce the energy loss in rotational reversal.

Figure 4:
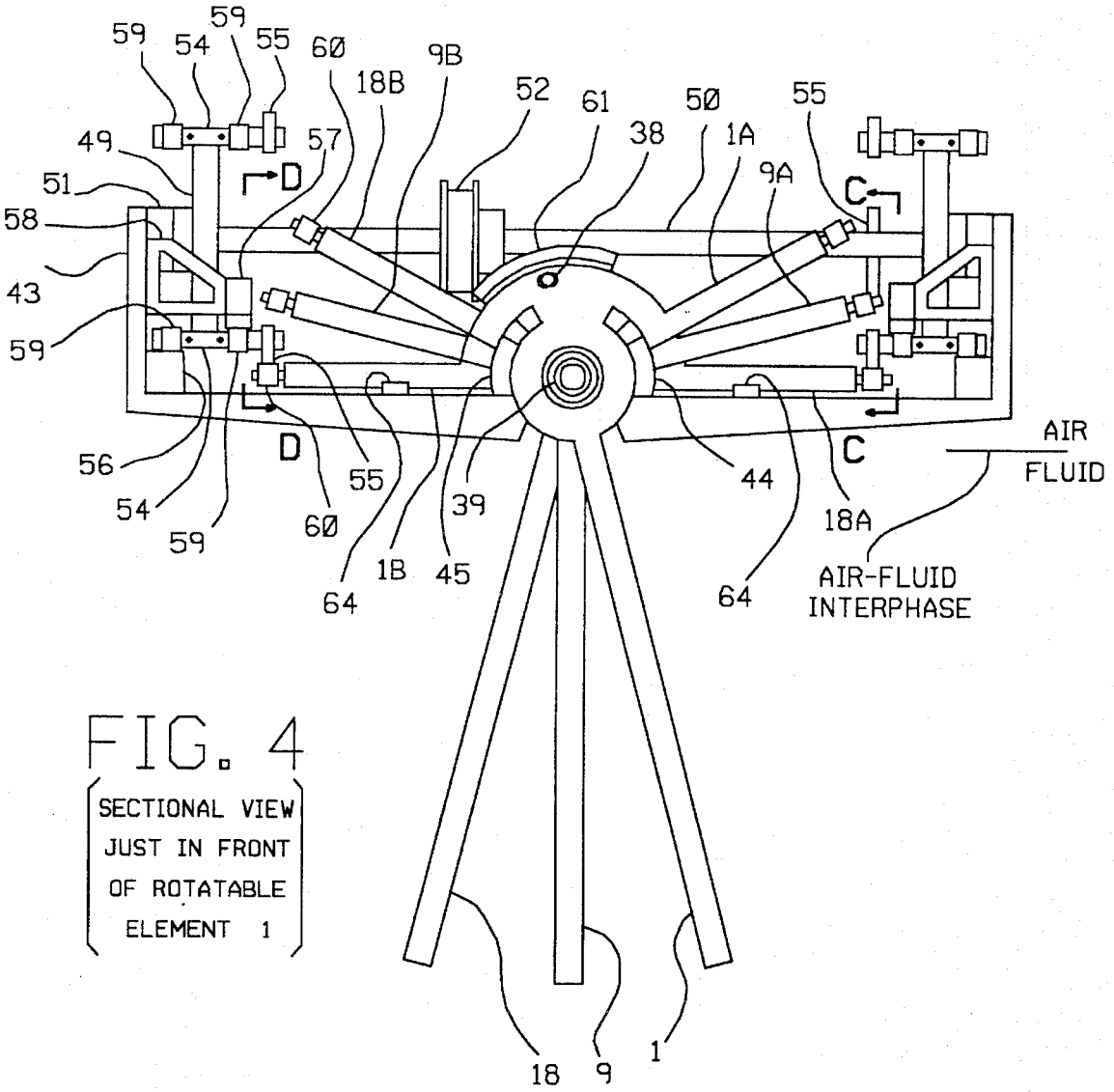
FIG. 4 is a sectional view of the entire device, starting just in front of the first rotatable element.

FIG. 4 is a sectional view at the front of the first rotatable element. It shows almost the entire device. For clarity, only elements 1, 9 and 18 are shown. The tray 43 supports the central axle 39 through two bearing blocks (not shown), supports the two drive systems through bearing blocks 51, supports the lower guide tracks 56 directly and supports the upper guide tracks 57 through triangular brackets 58. Since the two drive systems are similar, only the left one is identified with numbers. Each drive system has a modified commercial timing chain 53 driven by a chain sprocket 49. The passive sprocket is not shown. The commercial timing chain is a type made of equally spaced plastic rods linked by two light-weight cables. The timing chain is modified so that along the length of the chain there are four locations where three consecutive plastic rods are replaced by special rods 54, each with two rollers 59 to ride on the guide tracks 56 and 57.

A wedge 55 is attached to the end of the middle of the special plastic rod. There is a set of four wedges to drive the left side set of thirty-five arms, such as 1B, 9B, and 18B through their rollers at 60. (Greater detail will be shown in other figures.) Two shafts at 50 (only one shown) connects the sprockets of the two drive systems. A input pulley 52 is mounted on the shaft for power input. A curved bar 61 parallel to the central axle 39 connects the first rotatable element to the last rotatable element (not shown). The curved slot of the first element is shown accommodating the pin 38 of the succeeding element. Curved baffles 44 and 45 serve as dynamic seals in that region. Spring strip 64 of (either metal or plastic) serves to limit the maximum rotation of the arms and to force the rollers of the arms to follow the curvature of the wedge. Finally, the air-to-fluid inter-phase boundary is indicated.

Figure 5:
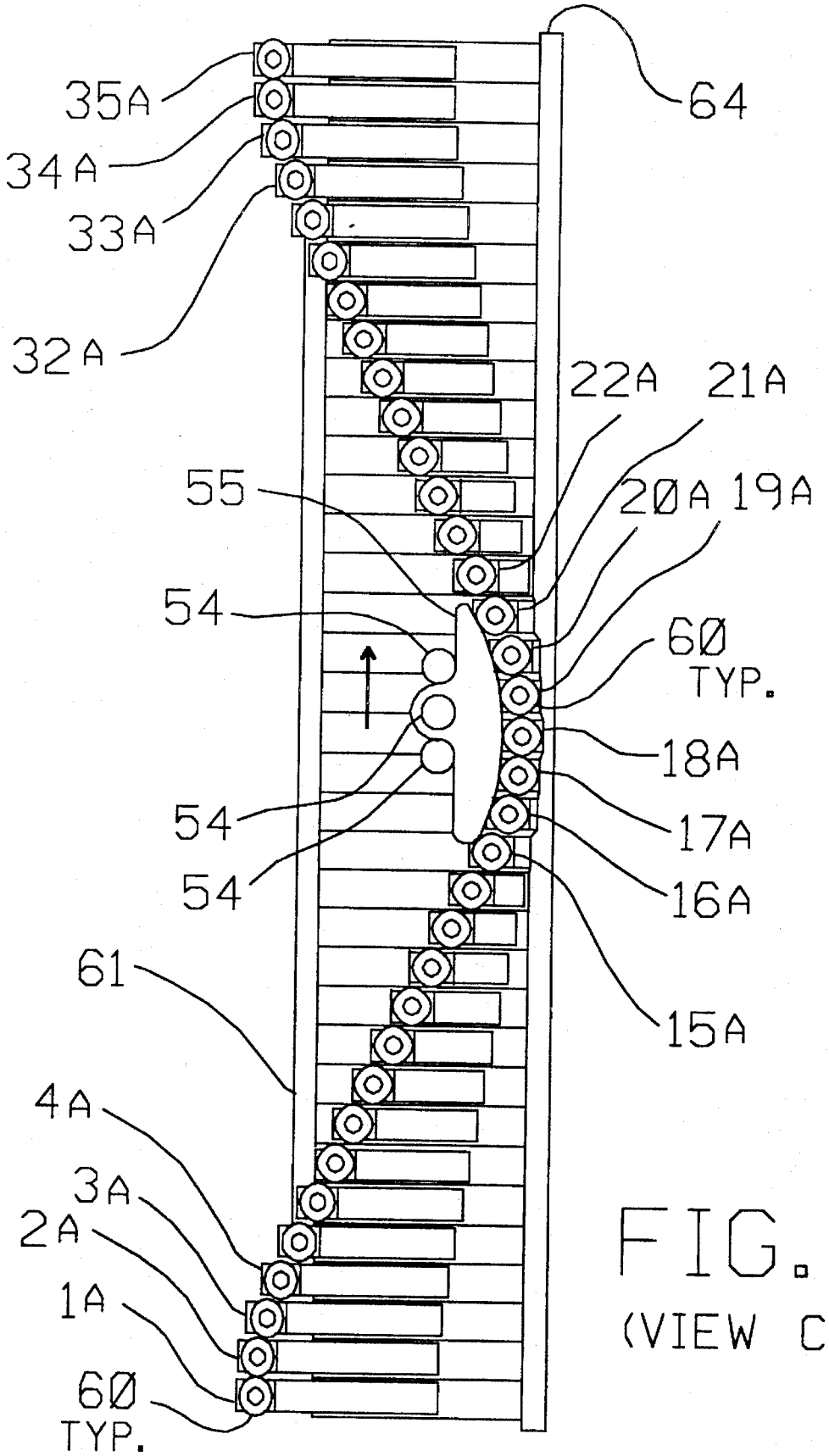
FIG. 5 is View C—C of FIG. 4, showing how one drive system engages one set of arms and rollers of the rotatable elements.

FIG. 5 is View C—C of FIG. 4. It shows one set of rollers 60 and arms 1A to 35A of the rotatable elements, the moving wedge 55 of one drive system and three modified rods 54 of the timing chain.

The wedge is shown attached to the middle rod; all three rods are rolling on the guide tracks (not shown) so that the wedge will maintain its angular orientation as it move in the direction of the arrow. The circular part of the wedge is shown in contact with the roller of arms 15A, to 21A. The spring strip 64 pushes those rollers upwards onto the wedge. As the wedge moves to the right, the arms 19A, 20A and 21A are forced to rotate downward to conform with the wedge. Arms 22A to 32A are forced to rotate downward also because, in each of those rotatable elements, the pin is catching the end of the slot of the preceding element.

Figure 6:
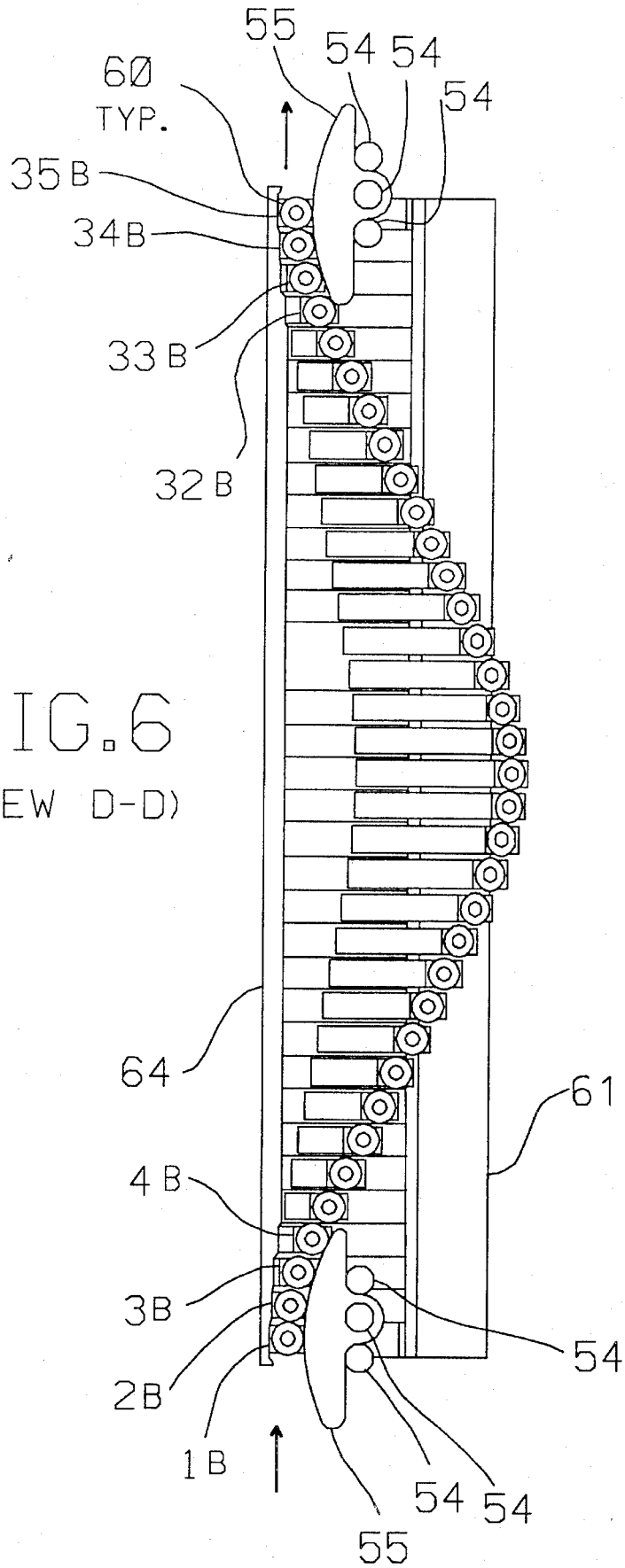
FIG. 6 is View D—D of FIG. 4, showing how the other drive system engages the other set of arms and rollers.

The right end of the wave, consisting of 32A, 33A, 34A and 35A is controlled by the left wedge in FIG. 6 acting on the B set of arms and rollers; while the left end of the wave, consisting of 1A, 2A, 3A and 4A is controlled by another wedge (the right wedge 55 in FIG. 6) acting on the B set of arms and rollers. Since the two sets of arms are linked together and the three wedges are moving in synchronization and since the first arm 1A is linked with last arm 35A, the wave as a whole is being moved in the direction of the arrow.

The general mechanism by which the wave is moved is one that uses the movement of the wedges to move the apex and trough of the wave. The pin-slot action between the rotatable elements aligns the elements between the apex and the trough in a straight line.

FIG. 6 is similar to FIG. 5 except it shows how the other drive system is driving the B set of arms. It shows View D—D of FIG. 4 from the opposite direction of view C—C of FIG. 4. That is why the direction arrow is pointing left. The right side wedge has just come in while the left side wedge is leaving. The connecting bar 61 is shown linking the first rotatable element to the last.

Figure 7:
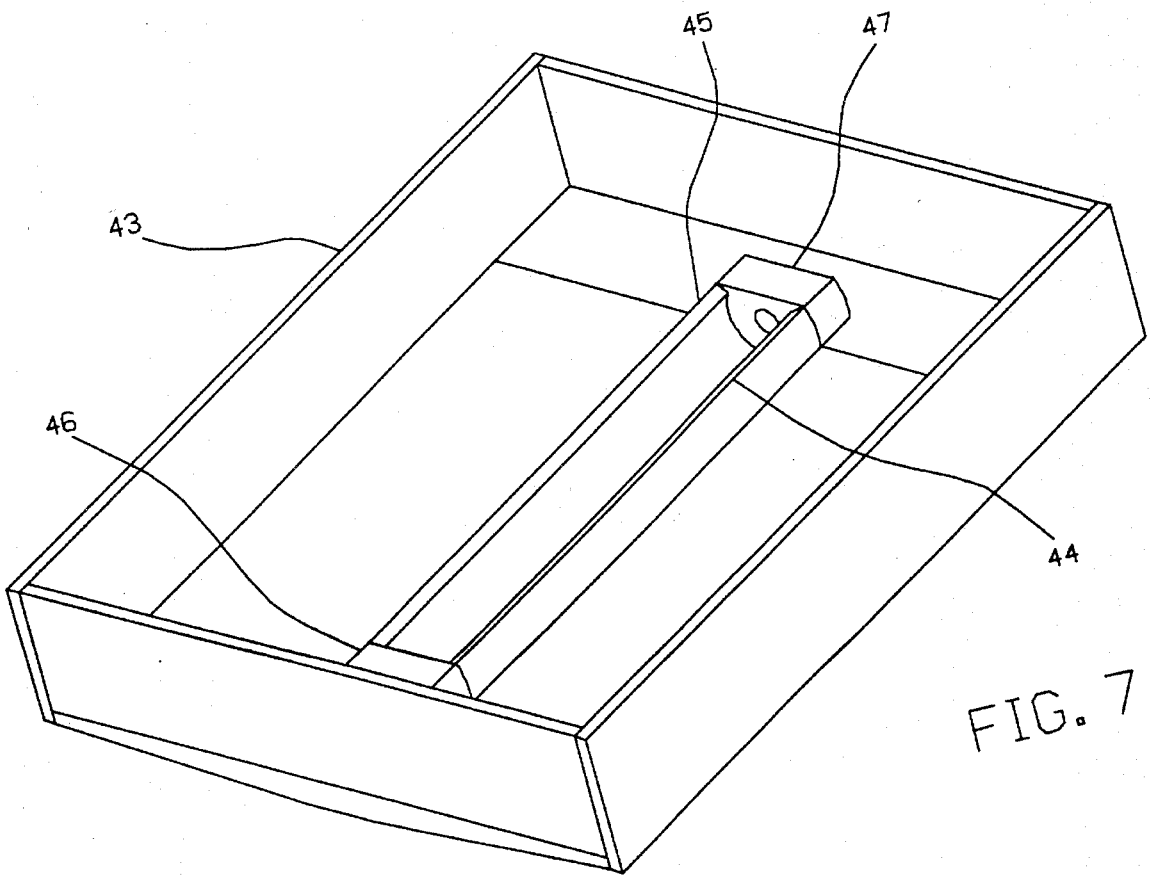
FIG. 7 is an isometric view of the tray that supports the central axle and the drive systems.

FIG. 7 is an isometric view of the tray 43. It also shows the front bearing block 46 for the central axle (not shown), the rear bearing block 47, the right curved baffle 44 and the left curved baffle 45. The function of 44 and 45 was covered in the description of FIG. 4.

Figure 8:
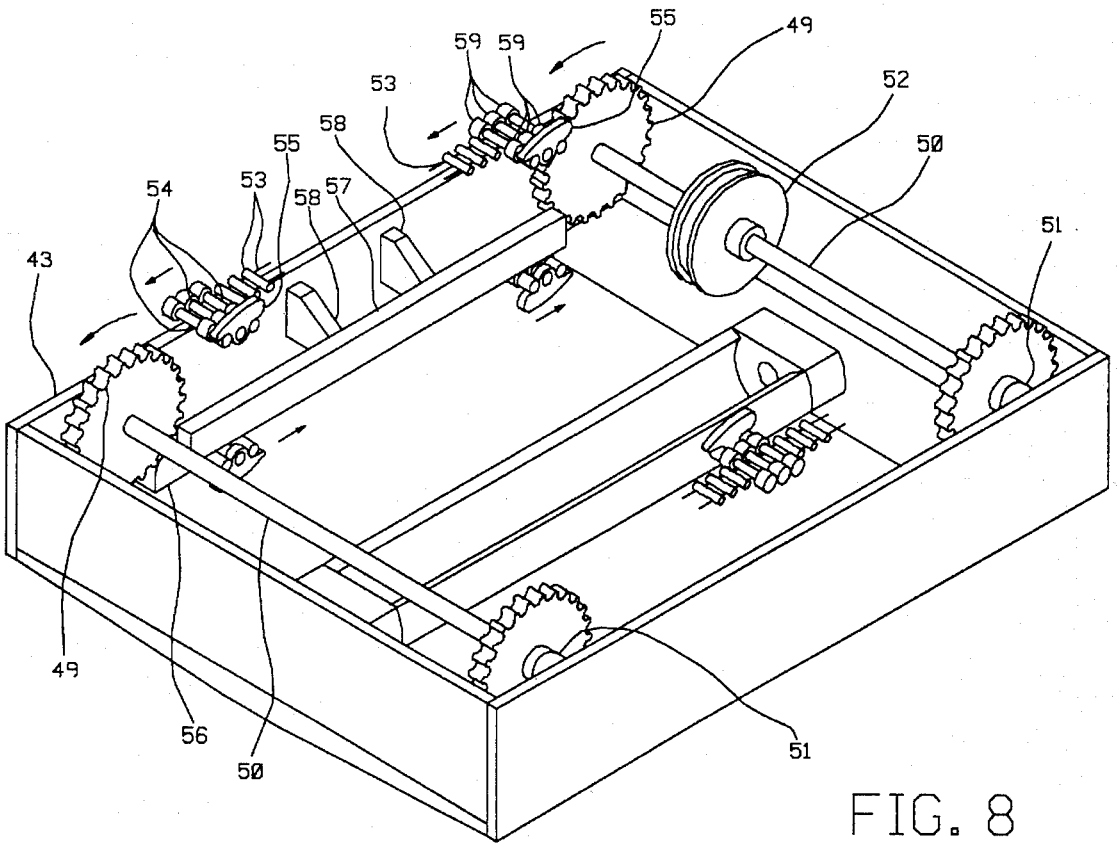
FIG. 8 is an isometric view, showing the relative locations of the two drive systems and the input pulley in the tray.

FIG. 8 is an isometric view of the two drive systems and the input pulley 52 assembled in the tray 43. The two drive systems are symmetrical. Only one system has number identification. The left system is shown with portions of the modified commercial timing chain 53 removed for clarity.

In the timing chain, there are four locations where three consecutive special rods 54 with rollers 59 are inserted. A wedge 55 is attached to the middle rod. The lower guide track 56 is attached to the side wall of the tray. The upper guide track 57 is attached to the side wall of the tray through two brackets 58. The guide tracks are used to guide the wedges when they are driving the wave. The timing chain is riding on an active sprocket 49 with input pulley 52 in one end and a passive sprocket 49 in the other end. The direction of motions of the timing chain and the sprockets are indicated by arrows. The active sprocket of the two drive system is coupled through a shaft 50 which is supported by two bearings 51 (only one visible). The bearings are mounted on the side walls of the tray. A power input pulley 52 is mounted on the shaft. A gear can be used instead of a pulley. Power can also be directly coupled to the shaft. The passive sprocket of the two drive systems is similarly coupled by a shaft and supported by bearings.

Figure 9:
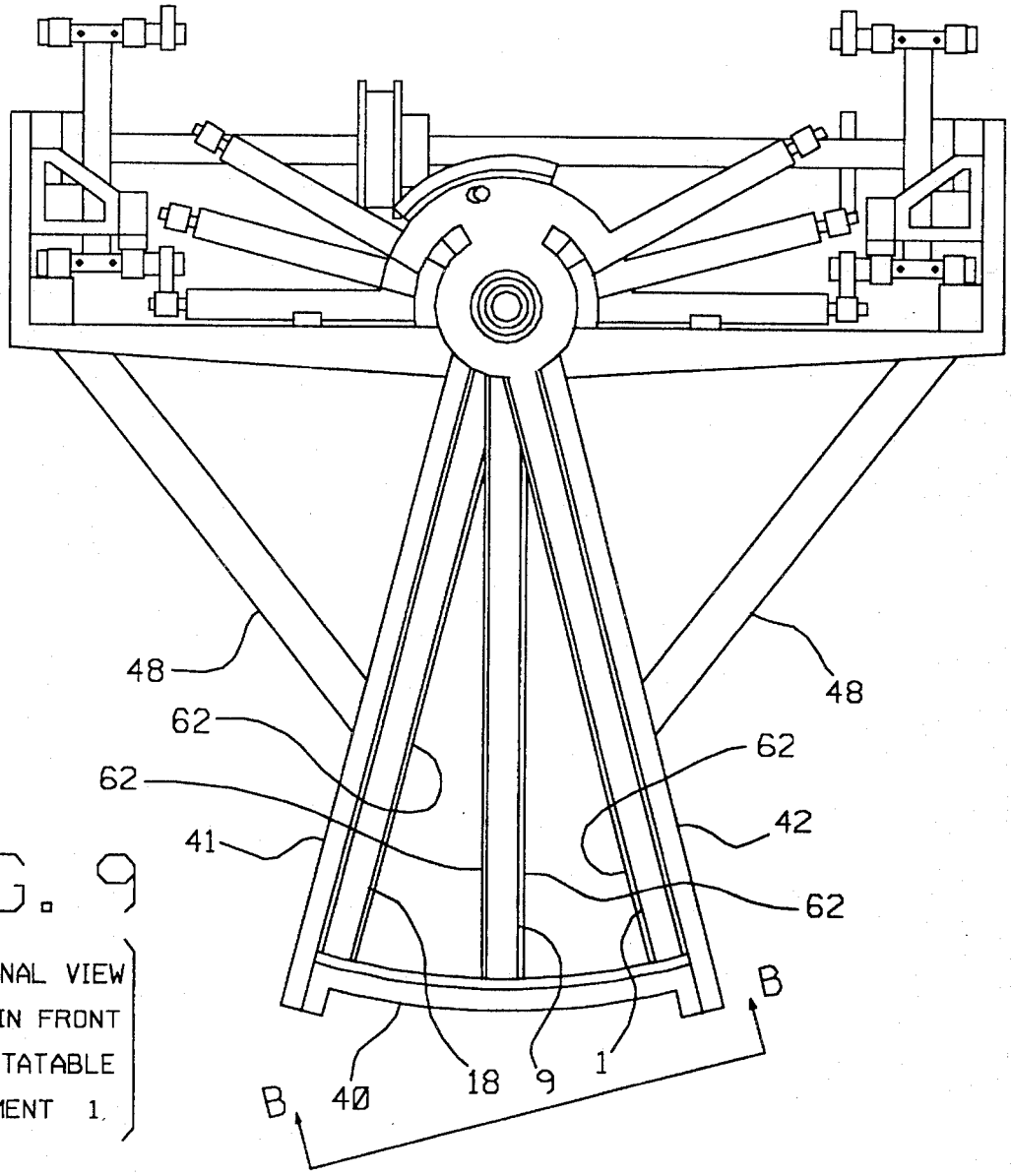
FIG. 9 is similar to FIG. 4 except that a duct is now shown enclosing the vertical immersed parts of the rotatable elements and that elastic sealing lips are added to the vertical immersed parts of the rotatable elements.

FIG. 9 is similar to FIG. 4 except that it shows the following components added to gain the ability to operate against back pressure and to increase efficiency by reducing the tendency of fluid to evade the entrainment action of the wave.

The ducting 40, 41 and 42 encloses the vertical immersed parts of the rotatable elements (only 1, 9 and 18 are shown). Stiffeners 48 for the duct are added. Elastic lips 62 are attached to the vertical immersed parts, providing a seal against the side wall of the duct.

Figure 10:
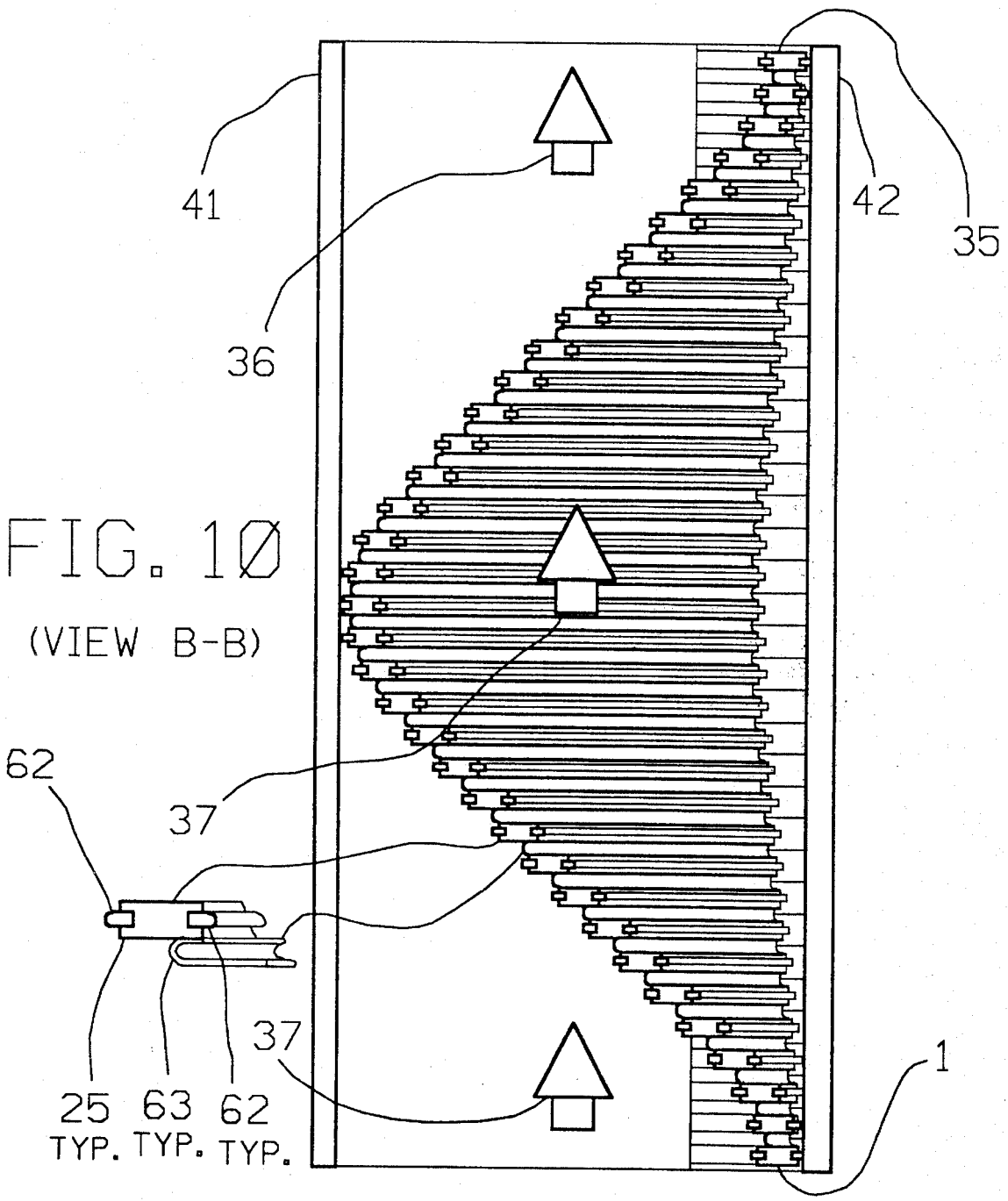
FIG. 10 is View B—B of FIG. 9 (with the bottom part of the duct removed), showing the vertical parts of the rotatable elements with sealing lips and webbings added.

FIG. 10 is View B—B of FIG. 9 (with the bottom part of the duct removed). The vertical immersed parts are modified for the addition of webbing 63 between rotatable elements. The webbing rolls between any two rotatable elements. Two elastic lips 62 are added to each of the vertical immersed parts. Lower left enlargement shows the two additions more clearly.

Figure 11:
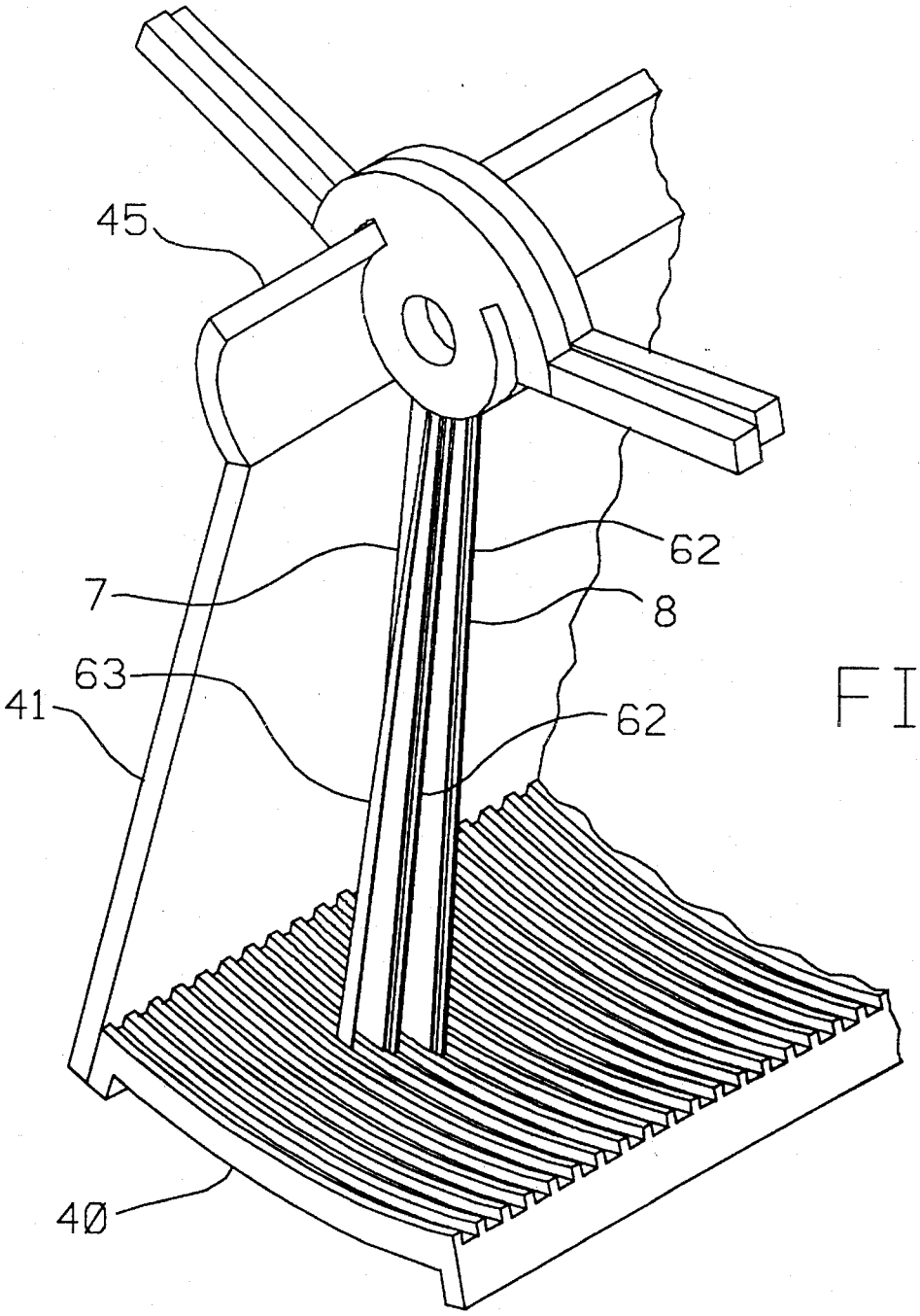
FIG. 11 is an isometric view of two of the rotatable elements in the duct (one side of the duct removed), with the grooves of the bottom piece of the duct showing and with sealing lips and webbings added to the vertical immersed parts of the rotatable elements.

FIG. 11 is an isometric view of two rotatable elements 7 and 8 in the duct 40 and 41 (one side of the duct is removed for clarity). The bottom part of the duct is shown with grooves that accommodate the ends of the vertical immersed parts for better sealing. The vertical immersed parts are shown with their elastic lips 62 and the webbing 63 between them.

What is claimed is:

1. A fluid forcing device comprising:

a central axle;

a multiplicity of rotatable elements fitting snugly together, each element rotating around the central axle, each element having a pin protruding in front and a curved slot of preset length in back, the pins and slots cooperating to limit movement of adjacent elements, each element having two radial arms terminating in a roller, and each element having a long downward pointing vertical part that is immersed in a fluid;

two sets of multiple wedges, each wedge having a curved edge to provide a surface for several of said rollers to bank against so that one wedge of one set will cause one group of arms and thereby also the immersed vertical parts materially attached to them to form the apex of a wave while one wedge of the second set will cause another group of arms and thereby also the immersed vertical parts materially attached to them to form the trough of the same wave;

a rigid mechanical connection between the first rotatable element and the last rotatable element to maintain the alignment of the above said wedges relative to the first and last rotatable elements;

two spring strips to force the above said rollers to bank against the wedges;

two sets of guiding tracks, one set for each said set of wedges, to guide the movement of the wedges and to locate the wedges and thereby the apex and trough of the wave;

two drive systems, one drive system for each said set of wedges, to move and to synchronize the position of the wedges which, in turn, move the wave as a whole;

a tray to support the central axle, drive systems, and tracks;

means to power the movement of the drive systems.

2. A fluid forcing device as in claim 1, further comprising a duct enclosing the immersed vertical parts, and said duct including grooves to recess and improve the sealing of the immersed vertical parts, so that the fluid forcing device is capable of operating against a back pressure and operating with a higher wave-to-fluid coupling efficiency.

3. A fluid forcing device as in claim 1, further comprising longitudinal elastic lips mounted on opposed edges of the immersed vertical parts to seal a gap between adjacent vertical parts, so that the fluid forcing device is capable of operating against a back pressure and operating with a higher wave-to-fluid coupling efficiency.

4. A fluid forcing device as in claim 1, further comprising elastic webbings between adjacent vertical immersed parts, so that the fluid forcing device is capable of operating against a back pressure and operating with a higher wave-to-fluid coupling efficiency.

* * * * *